US007753750B2

(12) United States Patent
Gutierrez

(10) Patent No.: US 7,753,750 B2
(45) Date of Patent: Jul. 13, 2010

(54) ELECTRICALLY POWERED BALANCED BUOYANCY AND VELOCITY OF MOVEMENT CONTROLLABLE LIFE-PRESERVING VEST AND TRANSPORT SYSTEM

(76) Inventor: Hector Gutierrez, 8817 Pershing Dr., Playa Del Rey, CA (US) 90293

( * ) Notice: Subject to any disclaimer, the term of this patent is extended or adjusted under 35 U.S.C. 154(b) by 136 days.

(21) Appl. No.: 12/082,728

(22) Filed: Apr. 12, 2008

(65) Prior Publication Data

US 2009/0258554 A1 Oct. 15, 2009

(51) Int. Cl.
*B63C 9/00* (2006.01)

(52) U.S. Cl. ..... 441/80; 441/117

(58) Field of Classification Search ..... 441/80, 441/117

See application file for complete search history.

(56) References Cited

U.S. PATENT DOCUMENTS 4,045,663 A * 8/1977 Young ..... 362/253
5,820,432 A * 10/1998 Wright ..... 441/119
7,223,143 B1 * 5/2007 Martin ..... 441/80

* cited by examiner

*Primary Examiner*—Stephen Avila
(74) *Attorney, Agent, or Firm*—Robert R. Meads

(57) ABSTRACT

An electrically powered and balanced buoyancy and velocity of movement controllable life preserving vest and transport system.

6 Claims, 7 Drawing Sheets

ELECTRICALLY POWERED BALANCED BUOYANCY AND VELOCITY OF MOVEMENT CONTROLLABLE LIFE-PRESERVING VEST AND TRANSPORT SYSTEM

BACKGROUND OF INVENTION

One of the principle functions of a life preserver is to preserve the life of one that is thrown or otherwise placed in a body of water. Life preservers accomplish this task by providing the user with the buoyancy needed to stay afloat. Prior life preservers come in a variety of shapes and sizes, ranging from floating rings to buoyant jackets.

While added buoyancy is essential to preserving the life of one thrown into water, other essentials for preserving life in such circumstances may be personal propulsion means and means for maintaining the buoyancy of the life preserver.

Prior personal water propulsion systems range from jet skies to motor powered surfboards and under water sleds and non-buoyant personal propulsion systems such as described in U.S. Pat. No. 5,170,739.

Accordingly, here is a need for an improved life preserver that provides and includes means for preserving the buoyancy of the preserver while adding propulsion means to the preserver. The present invention satisfies these needs.

SUMMARY OF INVENTION

Basically, the present invention is an electrically powered buoyancy and velocity of movement controllable life preserving vest and transport system. The system of the present invention comprises a life-preserving vest. The vest includes a top portion having an opening for receiving the head and neck of a wearer of the vest with a forward facing front portion and a rear facing rear portion of the vest releasably securable to enclose an upper portion of the body or torso of the vest wearer while forming an open bottom for receiving a lower body portion of the vest wearer. The front facing portion of the vest carries a vertically extending propulsion unit oriented to exert (i) a vertical lifting force on the vest wearer when the vest is in a vertical orientation and (ii) a forward horizontal propelling force on the vest wearer when the vest is in a horizontal orientation. The front facing portion of the vest also carries a floatation unit that extends vertically and laterally on opposite sides of the propulsion unit to exert balanced upward forces on the vest wearer to add needed balanced buoyancy to the vest wearer. Preferably, the floatation unit and the propulsion unit include user controllable means for respectively controlling the buoyancy of the floatation unit and the propulsion forces generated by the propulsion unit.

The foregoing and other features of the present invention will be more clearly understood by reference to the following detailed description when considered with the accompanying drawings.

BRIEF DESCRIPTION OF ACCOMPANYING DRAWINGS

Figure 2:
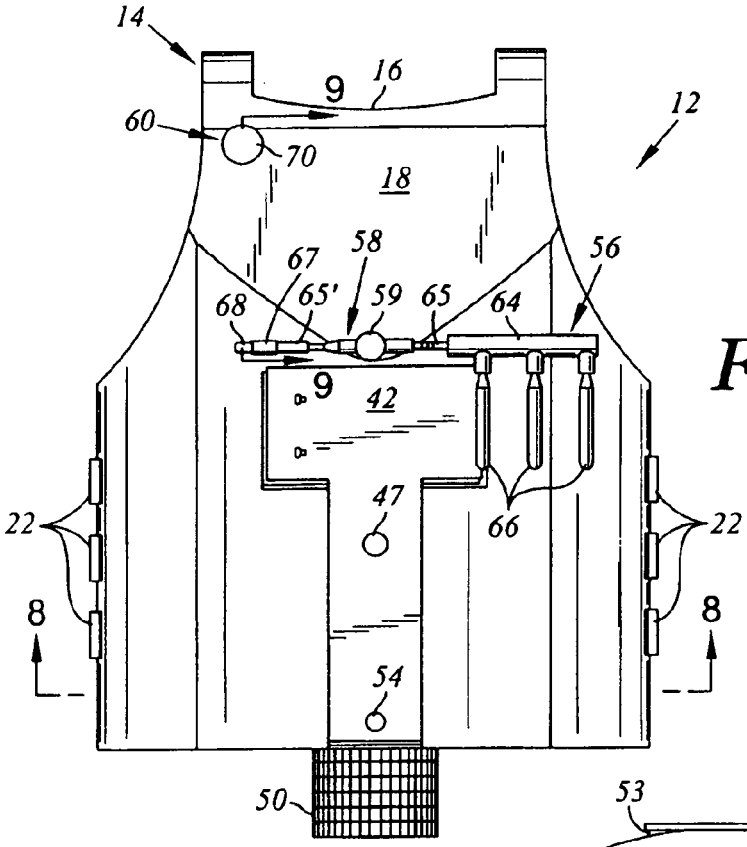
FIG. 2 is a front view of the assembled life preserving vest formed from the components illustrated in FIG. 1
Figure 3:
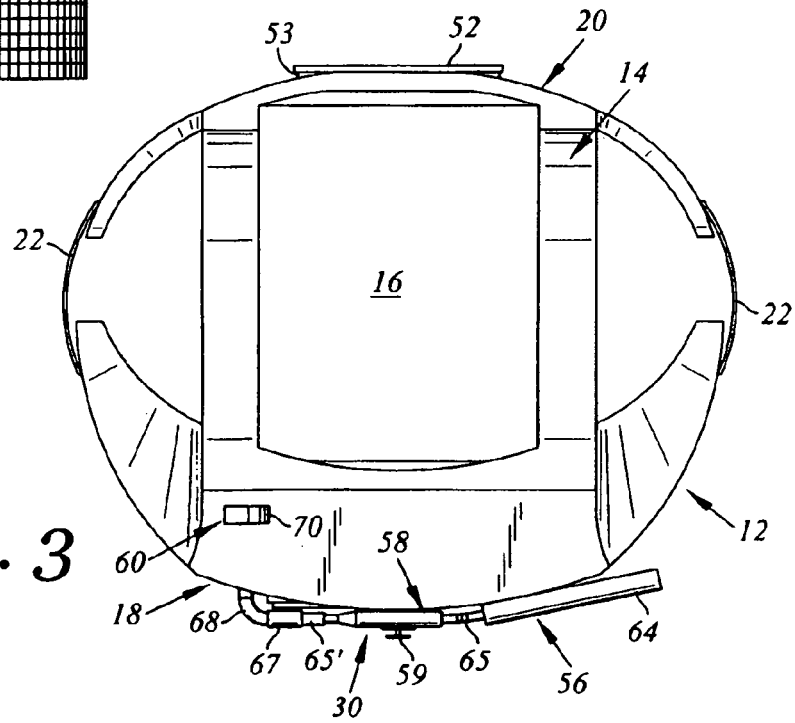
FIG. 3 is a top view of the vest shown in FIG. 2.
Figure 9:
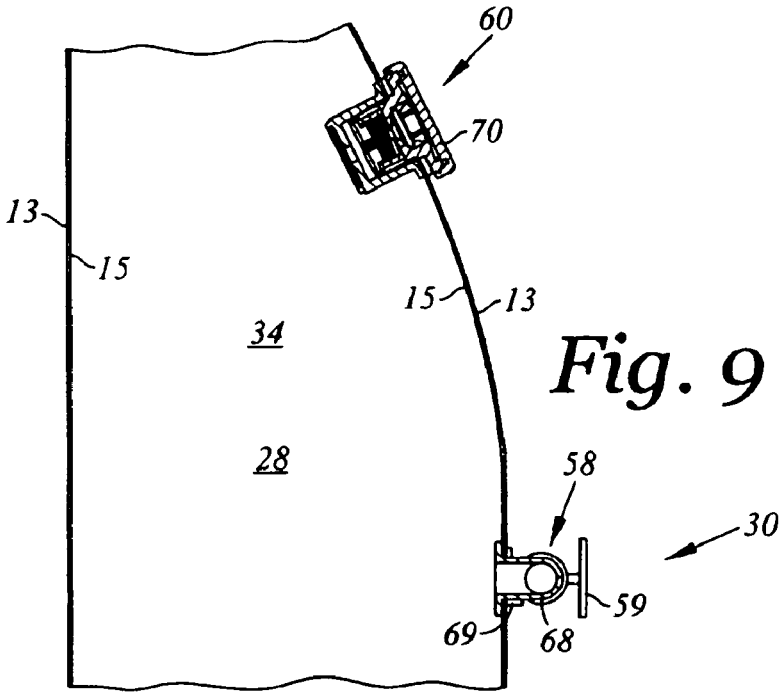

FIG. 9 is a reduced in size fragmentary cross-sectional view of the vest of FIG. 2 along the vertical line 9-9 in FIG. 2 looking to the right in the direction of the arrows and showing (i) an upper portion of the interior of the vest including a lateral connection portion of the interior compartment between right and left portions thereof housing the inflatable inner liner included in one form of the floatation unit, (ii) the connection of a compressed gas supply to an outer liner of the vest and to the inflatable liner included in the floatation unit and (iii) the connection of a compressed gas release to the outer liner of the vest and to the inflatable inner liner, the release being useful in regulating the buoyancy provided by the floatation unit.

Figure 10:
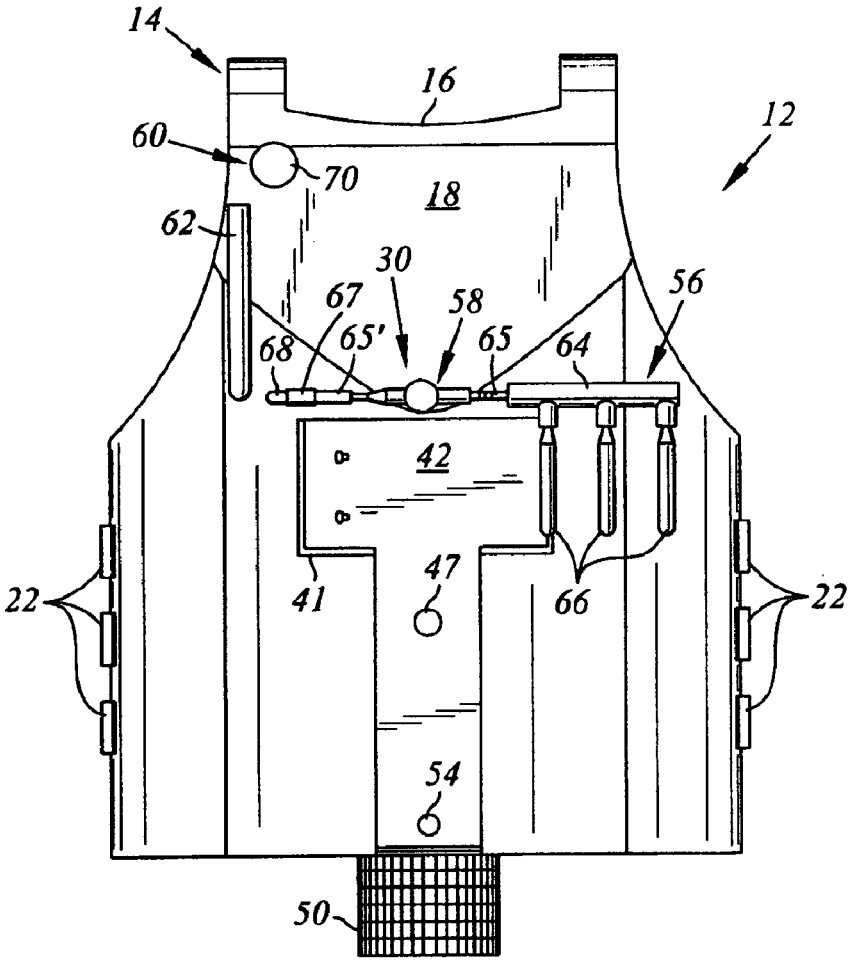

FIG. 10 is a front view of a slightly modified version of the vest shown in FIG. 2 adding an oral valve to a front of the vest for use by the vest wearer in the controlled inflation of the inner liner of the vest.

Figure 11:
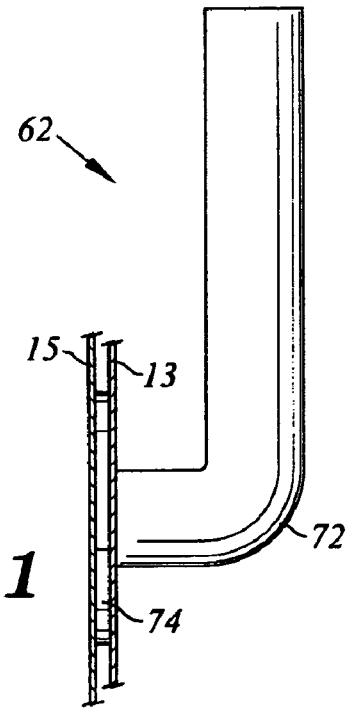

FIG. 11 is a sectional side view of the oral valve shown in FIG. 10 illustrating the manner in which the oral valve is secured to the outer liner of the vest and to the inner inflatable liner of the floatation unit of the vest.

Figure 4:
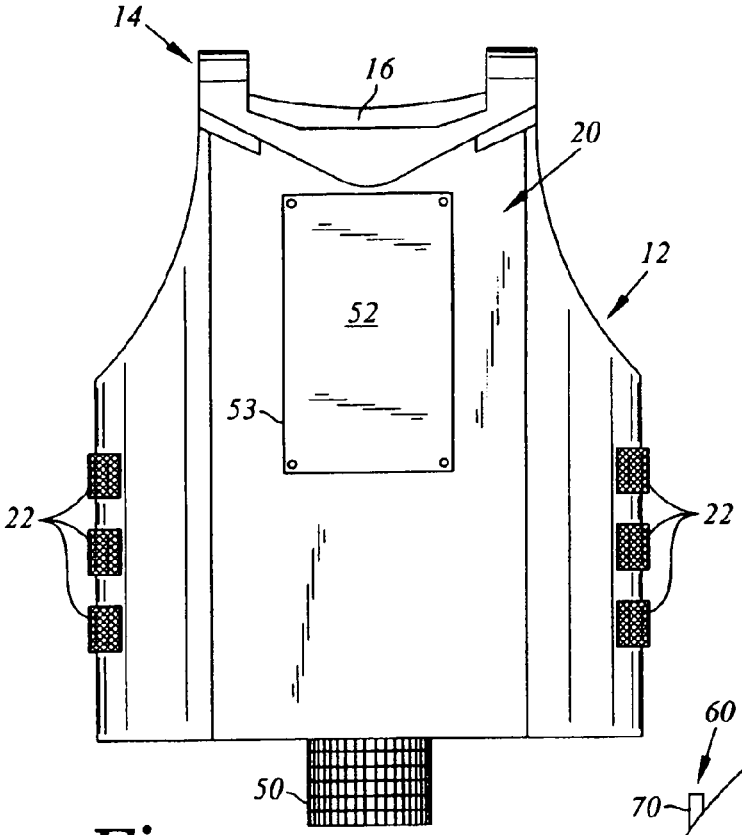
FIG. 4 is a back view of the vest shown in FIG. 2.
Figure 5:
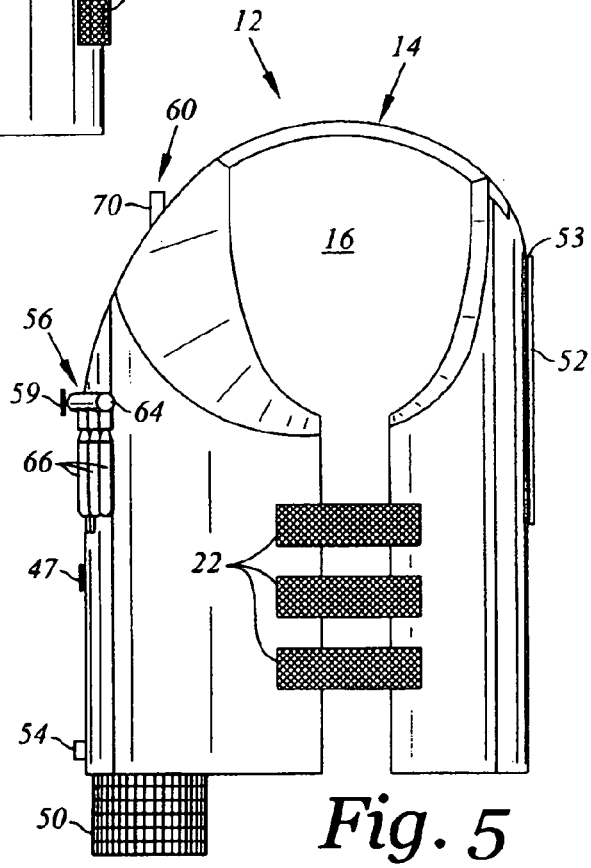
FIG. 5 is a right side view of the vest shown in FIG. 2.
Figure 6:
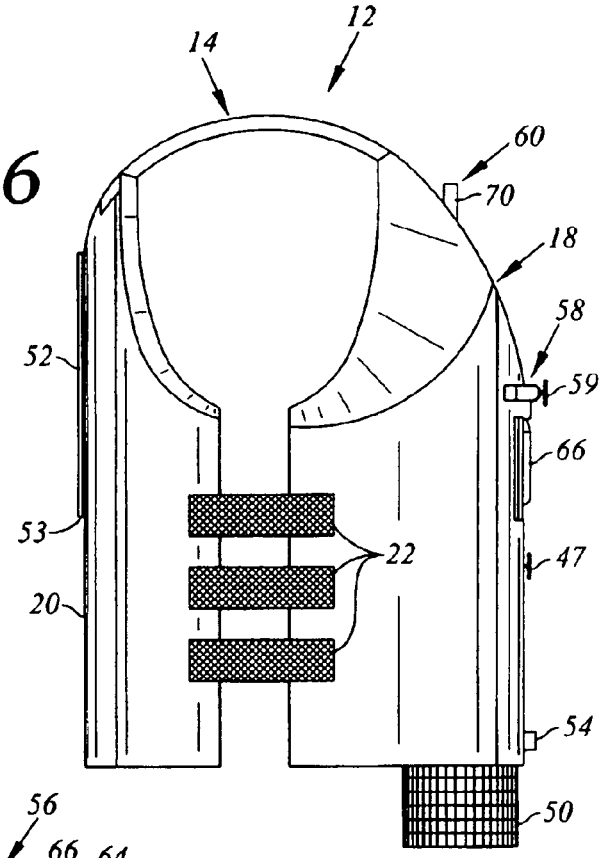
FIG. 6 is a left side view of the vest shown in FIG. 2.
Figure 7:
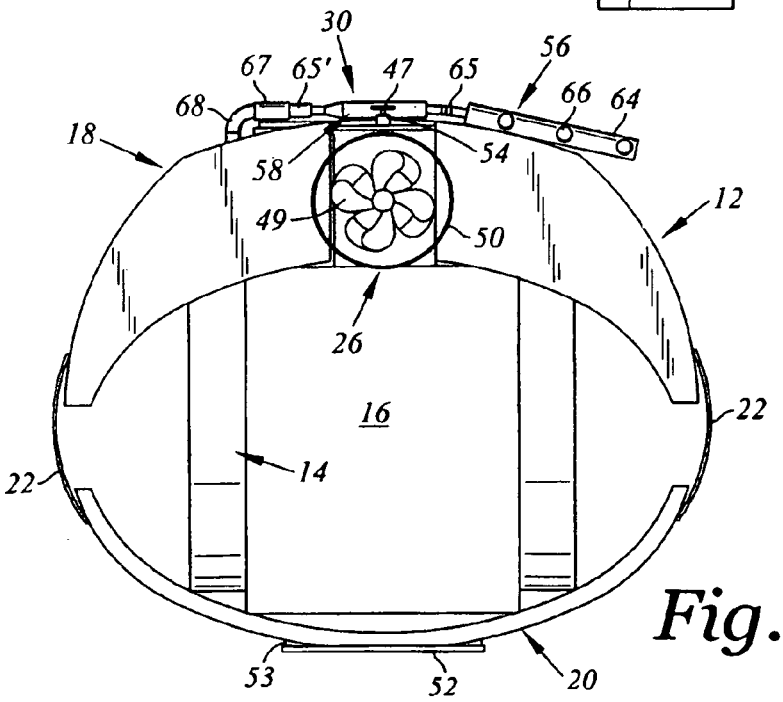
FIG. 7 is a bottom view of the vest shown in FIG. 2.
Figure 12:
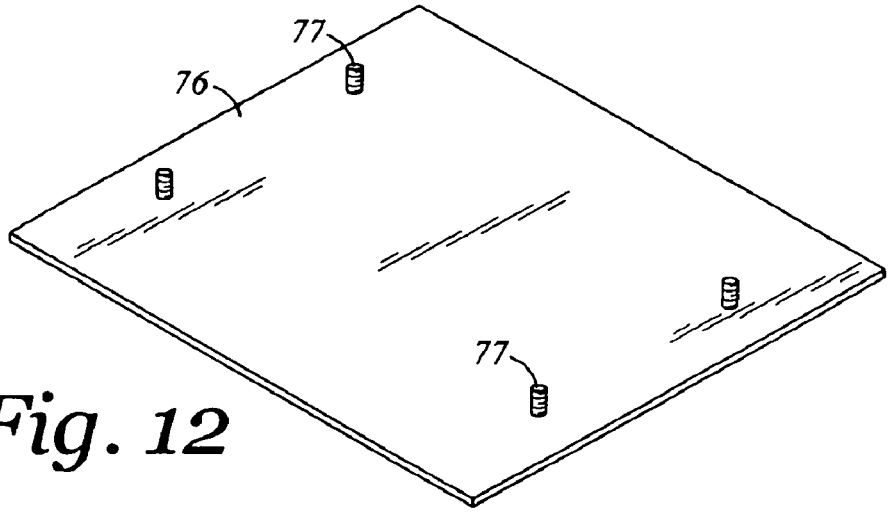

FIG. 12 is a perspective view of a mounting plate useful in releasably attaching a solar panel to a back of the vest as shown in FIG. 4.

Figure 13:
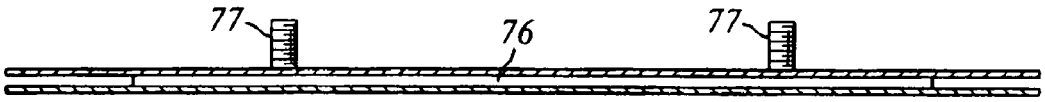

FIG. 13 is sectional side view of the mounting plate of FIG. 12 illustrating the manner that it is secured between the outer liner of the vest and inner inflatable liner of the floatation unit.

Figure 14:
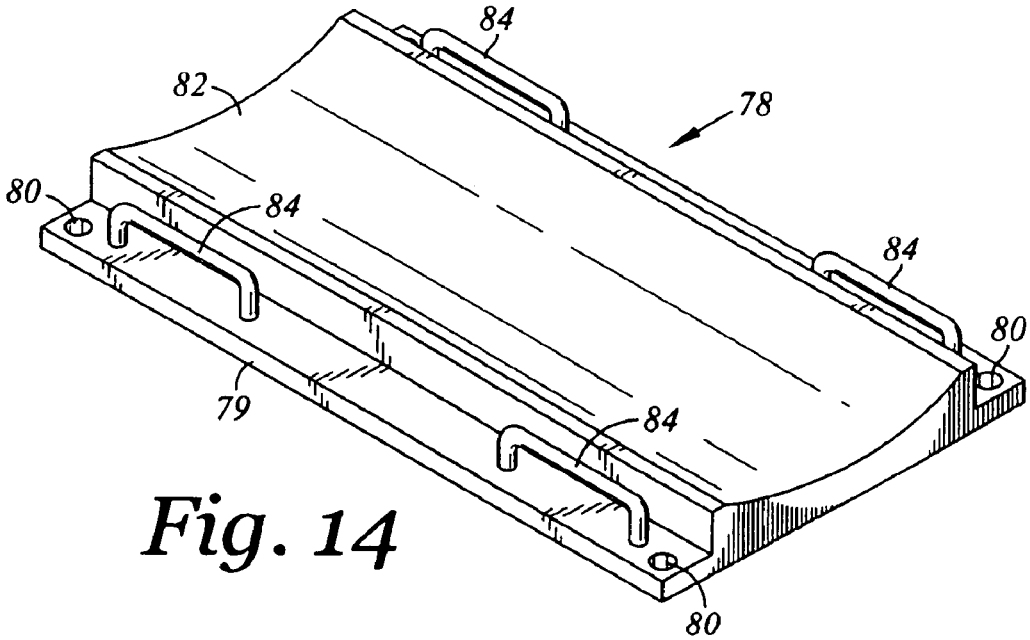

FIG. 14 is a perspective view of an oxygen tank adapter for attachment to the mounting plate of FIGS. 12 and 13 after removal of the solar panel enabling the vest to support an oxygen tank useable by a scuba diver wearing the vest.

DETAILED DESCRIPTION OF INVENTION

As depicted in the above referenced figures, the system of the present invention is represented by the number 10. Basically, the system 10 comprises a combination electrically powered buoyancy and velocity of movement controllable life preserving vest and transport system. The life preserving vest is depicted by the number 12 and is designed to receive and wrap around the upper torso of a vest wearer. In this regard, the vest 12 includes a top portion 14 having an upper opening 16 for receiving the head and neck of a wearer of the vest with a forward facing front portion 18 and a rear facing rear portion 20 of the vest releasably securable by conventional side straps 22 to enclose an upper torso portion of the body of the vest wearer while forming a bottom opening 24 from which a lower portion of the vest wearer vertically extends.

As illustrated, the front facing portion 14 of the vest 12 carries a vertically extending propulsion unit 26 oriented to exert (i) a vertical lifting force on the vest wearer when the vest 12 is in a vertical orientation and (ii) a forward horizontal propelling force on the vest wearer when the vest 12 is in a horizontal orientation.

The interior of the front facing portion 18 of the vest 12 also carries a floatation unit 28 that extends vertically and laterally on opposite sides of the propulsion unit 26 to exert balanced upward forces on the vest wearer to add the needed balanced buoyancy to the vest wearer.

As will be described in greater detail below, the floatation unit 28 and the propulsion unit 26 preferably include user controllable means 30 and 32 for respectively controlling the buoyancy of the floatation unit 28 and the propulsion forces generated by the propulsion unit 26.

Figure 1:
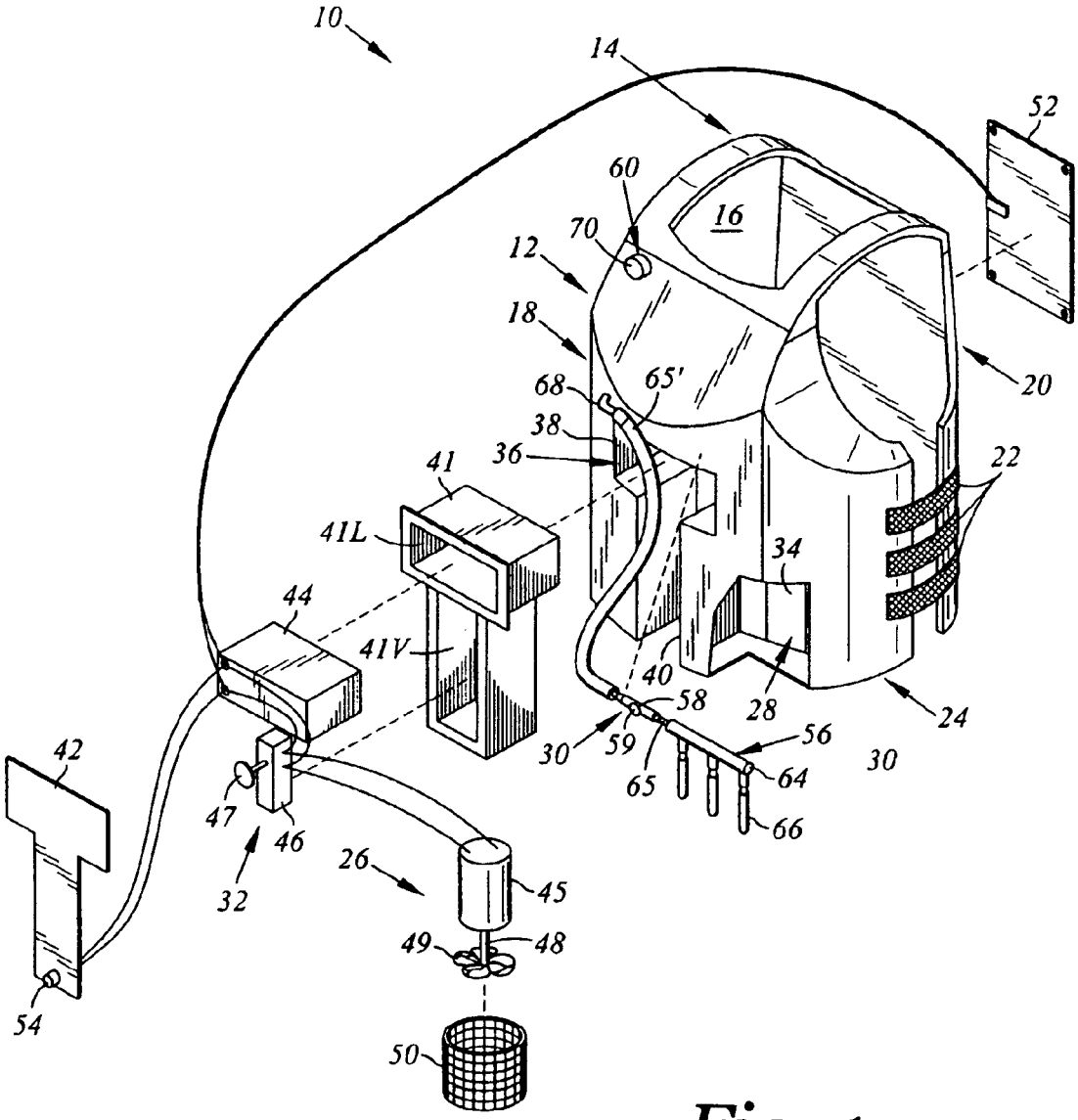
FIG. 1 is an exploded view of the components of a basic embodiment of the life preserving vest according to the present invention, the forward facing portion of the vest being cut away at the lower front corner to reveal a portion of an inverted generally "U" shaped air or compressed gas receiving compartment of a floatation unit within the vest.

As illustrated in FIGS. 1 and 2, in the basic form of the life-preserving vest 12, the front and rear facing portions 18 and 20 and the interior floatation unit 28 conform in shape generally to the front and rear of the upper body or torso of the wearer of the vest. In this regard, the vest 12 may be formed of a light-weight plastic material shaped or molded to form the front and rear portions 18 and 20 indicated in FIGS. 1-4 with an inverted generally "U" shaped air or compressed gas receiving compartment 34 formed in the front portion 18. Alternatively, as illustrated in FIGS. 8, 9, 11 and 13, the vest 12 may be formed of an outer flexible liner 13 formed of a vinyl or water-proof fabric mesh or the like supporting a hollow inner liner 15 of an expandable rubber or plastic material forming a closed air or compressed gas receiving compartment defining a preferred form of the balanced floatation unit 28 contained within the vest.

As illustrated, an outer front surface 30 of the vest 12 includes a centrally located T-shaped compartment 36 below the upper opening 16 of the vest. As illustrated in FIG. 1, the compartment 36 includes a laterally extending top portion 38 and a vertically extending bottom portion 40. The compartment 36 is dimensioned to receive and secure a T-shaped plastic box 41 having a T-shaped cover plate 42 for closing the box 41 to form a water-tight container. Specifically, as represented in FIG. 1, an upper lateral portion 41L of the box supports and contains a battery 44 for powering a dc motor 45 and a motor speed controller 46 housed and supported within a vertical portion 41V of the box 41. Preferably, the battery 44 is a rechargeable 12 volt Werker battery, part number WKA 12-7.5F available from AA Portable Power Corp., 2700 Rydin Road, Unit C, Richmond, Calif. Preferably, the dc motor 45 is part number 71-RE 800 manufactured by MFA/COMO DRILLS, Felderland Lane, Worth, Deal. Kent. CT14 OBT, United Kingdom. Preferably, the dc motor speed control 46 is kit number K67 manufactured by Ozitronics, 24 Ballandry Cresent, Greensbrough 3088, Victoria, Australia.

Basically, as is well understood by those familiar with speed controllers for dc motors, a manual turning or other movement of a knob 47 attached to a control arm extending from the speed control 46 for passage through the cover plate 42 produces an increase or decrease in the current applied to the dc motor 45 from the battery 44 and hence the speed of rotation of a drive shaft 48 extending vertically from a bottom of the motor 45 to which a propeller 49 is connected. Preferably, the propeller 49 comprises part number 4045 available from Pro Shop, 9700 Harbour Place, Mukilteo, Wash. and is housed in a cylindrical stainless steel propeller protection grill 50 extending from the bottom of the motor and available from McNichols Sheet, 14108 E. Arbor Place, Los Angeles, Calif.

As previously indicated, the battery 44 preferably is rechargeable. For example, as represented in FIGS. 1, 3, 4-7 and 12, such recharging of the battery 44 may be from a removable solar panel 52 attached to a mounting panel 53 connected to the rear facing portion 20 of the vest 12 or from an in-line charging port 54 secured to and extending through the plastic box cover plate 42, each being represented as being electrically connected to the terminals of the battery 44. Preferably, the solar panel 52 is part number SC3-12 manufactured by Sunwize Technologies, Inc. and available from Alternative Energy Store, 43 Broad Street, Hudson, Mass. and the in-line charging port 54 is the 2 pin in-line port part number DNX-410 available from Electric Scooter Parts, 1390 Pine Street, Boulder Creek, Calif. and is suitable for connection to an external power source for recharging of the battery 44 as desired.

Figure 8:
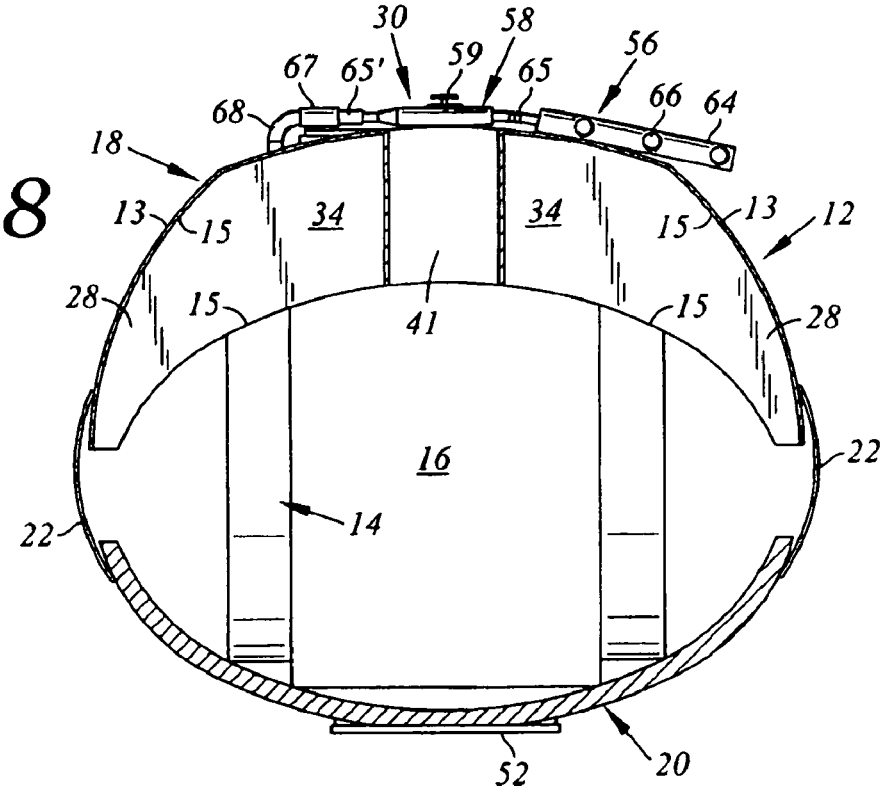
FIG. 8 is a reduced in size cross-sectional view of the vest of FIG. 2 along the horizontal line 8-8 in FIG. 2 looking upward in the direction of the arrows and showing the interior of the vest including the interior compartment housing an inflatable inner liner included in one form of the floatation unit within the vest.

As previously indicated, important features of the preferred embodiment of the vest 12 of the present invention reside in the controllable and balanced upward buoyancy forces developed by the floatation unit 28 included in the vest 12. As previously indicated, the balanced buoyancy forces result from the shape of the compartment or flotation chamber 34 within the floatation unit 28 extending vertically on opposite sides of the vertically oriented propulsion unit 26. Specifically, as illustrated in FIGS. 8 and 9, with the propulsion unit 26 centrally located in the front portion of the vest 12, the vertically extending portions of the compartment or floatation chamber 34 formed in the vest or the inflatable inner liner 15 thereof on right and left sides of the propulsion unit maintain balanced upward buoyancy forces within the vest that are transmitted to the wearer of the vest and act to maintain the vertical stability of the vest wearer in the water in which he or she has been placed.

In the present invention, the control of such balanced buoyancy is provided by sources of air and compressed gas for the floatation unit 28 and vest-wearer controllable valves associated with supply and release of the compressed gas and air. More particularly, as represented in FIGS. 1-3 and 5-11, a compressed gas supply 56 and vest-wearer controllable compressed gas supply valve 58 and relief valve 60 are included in each illustrated embodiment of the vest 12 while a vest-wearer controllable air supply and relief valve 62 is also included in the vest embodiment illustrated in FIGS. 10 and 11.

Specifically relative to the compressed gas supply 56, compressed gas supply valve 58 and relief valve 60, as shown in FIGS. 1-3 and 5-11, a multiple compressed gas cartridge connector 64 for a series of compressed gas cartridges 66 is mounted on a front of the vest 12 above and to the right of the propulsion unit 26. The compressed gas control valve 58 is also mounted on the front of the vest 12 and connected to an outlet of the compressed gas cartridge connector 64 by a short length of hose 65. The hose 65 feeds compressed gas from the connector 64 to the supply valve 58 and hence through a hose 65' to a hose connector 67. The hose connector 67, in turn, is connected to an L-shaped tubing connector 68 secured to the front portion of the vest 12 and by a standard adhesive air-tight connection 69 to the compartment 34 or inner liner 15 of the flotation unit 28 within the vest as depicted in FIG. 9.

The multiple compressed gas cartridge connector 64 is available from Iron works, Inc., 8319 S. Hindry, Los Angeles, Calif. and comprises an axially elongated horizontally extending hollow cylinder closed at one end and having as series of downwardly extending internally threaded compressed gas cartridge receiving couplings each surrounding a tubular compressed gas cartridge piercing orifice for passing compressed gas from the associated cartridge 66 to a central channel leading to an open end of the connector, the exterior of which is shaped to tightly receive the hose 65 extending from the compressed gas supply valve 52 preferably comprising the part number 57100 Delin rotary air valve available from Micro-Vac, Tucson, Ariz. and including a user-turnable knob 59 for opening, closing and regulating the flow of gas through the valve.

The compressed gas cartridges 66 depicted in the drawings preferably comprise CO2 cartridges manufactured by Mosa Ind. Corp. Colden City Garden, Dinxi Road, Shanghai, China, while the L-shaped tubing connector 68 depicted in FIG. 9 is available from Halkey-Roberts Corporation, St. Petersburg, Fla. as is the standard poppet-type relief valve assembly 60 (e.g. part number 984XXX022 or 1080RP) shown in FIGS. 1-3, 5-7 and 9. As illustrated most clearly in FIG. 9, the tubing connector 68 and the relief valve 60 are secured to the front of the vest 12 and adhesive sealed or welded to the inner liner 15. The relief valve 60 includes a turnable cap 70 for opening and closing the relief valve to allow air and/or compressed gas in the compartment 34 or inner liner 15 to exit the floatation unit 28 through the cap to regulate the buoyancy provided by the floatation unit.

Thus, to activate the floatation unit 28 and to control the buoyancy provided to the vest 12 shown in FIGS. 1-9, the CO2 cartridges 66 are secured to the cartridge connector 64 to release compressed gas into the connector. The control knob 59 of the supply valve 58 is then turned to allow compressed gas to flow through the hose 65' and hose connector 67 to the L-shaped tubing connector 68 into the compartment 34 or inner liner 15 to fill the floatation unit 28 with compressed gas. To regulate the buoyancy provided by the compressed gas in the floatation unit 28, the vest wearer my turn the control knob 70 to allow a controlled amount of compressed gas to escape from the relief valve 60.

As previously mentioned, in addition to the buoyancy control provided by the relief valve 60, the embodiment of the vest 12 shown in FIGS. 10 and 11 includes the vest-wearer controllable air supply and relief valve 62 comprising an L-shaped oral tube 72 secured to the front of the vest and extending upward to allow a wearer of the vest to blow into the tube and pass air into to the compartment 34 or inner liner 15 to supplement or replace the compressed air therein. The oral tube 72 may comprise the oral tube/oral valve combination part number 740ROLXXX manufactured and commercially available from Halkey-Roberts Corporation of St. Petersburg, Fla. including an internal one-way oral valve part number 740 (not shown) and an oval end plate 74 for adhesive sealing or welding to the interior of the compartment 34 or between the outer liner 13 and outside of the expandable inner liner 15 of the preferred form of the floatation unit 28 as shown in cross-section in FIG. 11.

Also, to afford greater flexibility of use for the vest 12, a compressed-gas scuba tank may replace the solar panel 52. To allow for such replacement, a plastic mounting plate 76 may be secured to the back 20 as shown in FIG. 12. As represented in FIG. 13, the plastic plate 76 is secured by adhesive sealing or welding between the outer liner 13 and inner liner 15 of the back of the vest 12 with stainless steel screws 77 extending from the plastic plate to provide a connection to the solar panel 52 or to a scuba tank mounting plate 78 such as shown in FIG. 14. The scuba tank mounting plate 78 preferably includes a rectangular plate 79 having screw receiving holes 80 at the four corners thereof for receiving the screws 77 extending from the plastic mounting plate of FIG. 13 and an axially elongated concave central portion 82 for receiving the scuba tank with adjacent loops 84 for receiving straps that will secure the tank to the mounting plate 76.

While preferred forms of the present invention have been described above, changes and modifications may be made in the illustrated forms without departing from the spirit of the invention. Accordingly, the scope of the invention is to be limited only by the terms of the following claims.

The invention claimed is:

1. An electrically powered buoyancy and velocity of movement controllable life preserving vest and transport system, comprising:

a life preserving vest including a top portion having an upper opening for receiving the head and neck of a wearer of the vest with a forward facing front portion and a rear facing rear portion of the vest releasably securable to enclose an upper portion of the body of the vest wearer while forming an open bottom for receiving a lower portion of the vest wearer;

the forward facing front portion of the vest including (i) a centrally located vertically extending compartment containing a vertically extending propulsion unit oriented to generate a vertical lifting force on the vest wearer when the vest is in a vertical orientation and a forward horizontal propelling force on the vest wearer when the vest is in a horizontal orientation and (ii) a floatation unit including a floatation chamber extending vertically and laterally within the vest on opposite sides of and planar with the vertically extending compartment and the vertically extending propulsion unit contained therein to exert balanced upward forces on the vest wearer to add needed buoyancy to the vest wearer; and the forward facing front portion of the vest supporting user controllable means for controlling the buoyancy of the floatation unit and user controllable means for controlling the propulsion forces generated by the propulsion unit.

2. The system of claim 1 wherein the propulsion unit comprises a water tight compartment releasably secured within the vertically extending compartment in the forward facing front portion of the vest and containing a battery for powering a motor including a drive shaft extending vertically downward from the water tight compartment and supporting a propeller at a lower end of the shaft and housed within a protector for the propeller.

3. The system of claim 2 wherein the propulsion unit includes a user controllable means within the water tight compartment for controlling speed of operation of the motor.

4. The system of claim 1 further including user controllable means for introducing compressed gas or air into the floatation chamber to increase the buoyancy of the floatation unit.

5. The system of claim 1 wherein the floatation unit comprises user controllable means for inflating an expandable inner liner in the floatation unit.

6. The system of claim 5 wherein the user controllable means also deflates the inner liner.

* * * * *